US006192707B1

(12) United States Patent
Shah et al.

(10) Patent No.: US 6,192,707 B1
(45) Date of Patent: Feb. 27, 2001

(54) CRYOGENIC SYSTEM FOR PRODUCING ENRICHED AIR

(75) Inventors: Minish Mahendra Shah, East Amherst; Raymond Francis Drnevich, Clarence Center, both of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/438,921

(22) Filed: Nov. 12, 1999

(51) Int. Cl.[7] ..... F25J 3/00
(52) U.S. Cl. ..... 62/648; 62/653
(58) Field of Search ..... 62/640, 643, 647, 62/648, 653, 654

(56) References Cited

U.S. PATENT DOCUMENTS

| | | | | |
|---|---|---|---|---|
| 2,079,019 | | 5/1937 | Karwat | 75/41 |
| 4,022,030 | | 5/1977 | Brugerolle | 62/30 |
| 4,224,045 | | 9/1980 | Olszewski et al. | 62/30 |
| 4,792,441 | | 12/1988 | Wang et al. | 423/359 |
| 5,244,489 | | 9/1993 | Grenier | 75/466 |
| 5,582,036 | | 12/1996 | Drnevich et al. | 62/656 |
| 5,592,832 | | 1/1997 | Herron et al. | 62/646 |
| 5,609,041 | * | 3/1997 | Rathbone et al. | 62/646 |
| 5,675,977 | | 10/1997 | Prosser | 62/646 |
| 5,736,116 | | 4/1998 | LeBlanc et al. | 423/359 |
| 6,006,545 | * | 12/1999 | Tranier | 62/615 |
| 6,062,043 | * | 5/2000 | Magnet et al. | 62/643 |

FOREIGN PATENT DOCUMENTS 604554 7/1998 (EP) .

* cited by examiner

*Primary Examiner*—William Doerrler
(74) *Attorney, Agent, or Firm*—Stanley Ktorides

(57) ABSTRACT

A system for producing enriched air wherein a multistage compressor is integrated with a cryogenic air separation plant and serves to compress feed air for the plant while also compressing both air and oxygen fluid from the plant to produce the enriched air.

10 Claims, 3 Drawing Sheets

CRYOGENIC SYSTEM FOR PRODUCING ENRICHED AIR

TECHNICAL FIELD

This invention relates generally to cryogenic air separation and, more particularly, to the production of enriched air.

BACKGROUND ART

Many industrial processes, such as combustion and chemical oxidation, require enriched air as a process input. Often the enriched air is required by the industrial process at a relatively high pressure, typically at a pressure much higher than that at which an air separation plant operates. This creates an inefficiency.

Accordingly it is an object of this invention to provide a system for producing enriched air, especially relatively high pressure enriched air, which employs a cryogenic air separation plant and which operates with improved efficiency over conventional systems for providing enriched air.

SUMMARY OF THE INVENTION

The above and other objects, which will become apparent to those skilled in the art upon a reading of this disclosure, are attained by the present invention, one aspect of which is:

A method for producing enriched air comprising:

(A) passing feed air to a multistage compressor, compressing the feed air in the multistage compressor to produce compressed feed air, and passing a first portion of the compressed feed air into a cryogenic air separation plant;

(B) separating compressed feed air in the cryogenic air separation plant by cryogenic rectification to produce oxygen fluid;

(C) passing oxygen fluid from the cryogenic air separation plant to the multistage compressor, and mixing oxygen fluid within the multistage compressor with a second portion of the compressed feed air to produce enriched air; and (D) further compressing the enriched air within the multistage compressor and recovering further compressed enriched air from the multistage compressor.

Another aspect of the invention is:

Apparatus for producing enriched air comprising:

(A) a multistage compressor comprising an initial stage and a final stage, and means for passing feed air to the initial stage of the multistage compressor;

(B) a cryogenic air separation plant and means for passing feed air from the multistage compressor to the cryogenic air separation plant, said means communicating with the multistage compressor downstream of the initial stage;

(C) means for passing oxygen fluid from the cryogenic air separation plant to the multistage compressor at a point upstream of the final stage; and (D) means for recovering enriched air from the final stage of the multistage compressor.

As used herein the term "oxygen fluid" means a fluid having an oxygen concentration of at least 40 mole percents preferably at least 80 mole percent, most preferably at least 95 mole percent.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing For a further discussion of distillation columns, see the Chemical Engineer's Handbook, fifth edition, edited by R. H. Perry and C. H. Chilton, McGraw-Hill Book Company, New York, Section 13, The Continuous Distillation Process.

The term "double column" is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the more volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component (s) in the liquid phase. Rectification, or continuous distillation, is the separation process that combines successive partial vaporizations and condensations as obtained by a countercurrent treatment of the vapor and liquid phases The countercurrent contacting of the vapor and liquid phases can be adiabatic or nonadiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K)

As used herein the term "enriched air" means a fluid having an oxygen concentration within the range of from 25 to 50 mole percent, with the remainder being primarily nitrogen.

As used herein the term "indirect heat exchange" means the bringing of two fluid streams into heat exchange relation without any physical contact or intermixing of the fluids with each other.

As used herein the term "feed air" means a mixture comprising primarily oxygen and nitrogen, such as ambient air.

As used herein the term "cryogenic air separation plant" means a plant comprising at least one column, which processes feed air and produces oxygen fluid.

DETAILED DESCRIPTION

Figure 1:
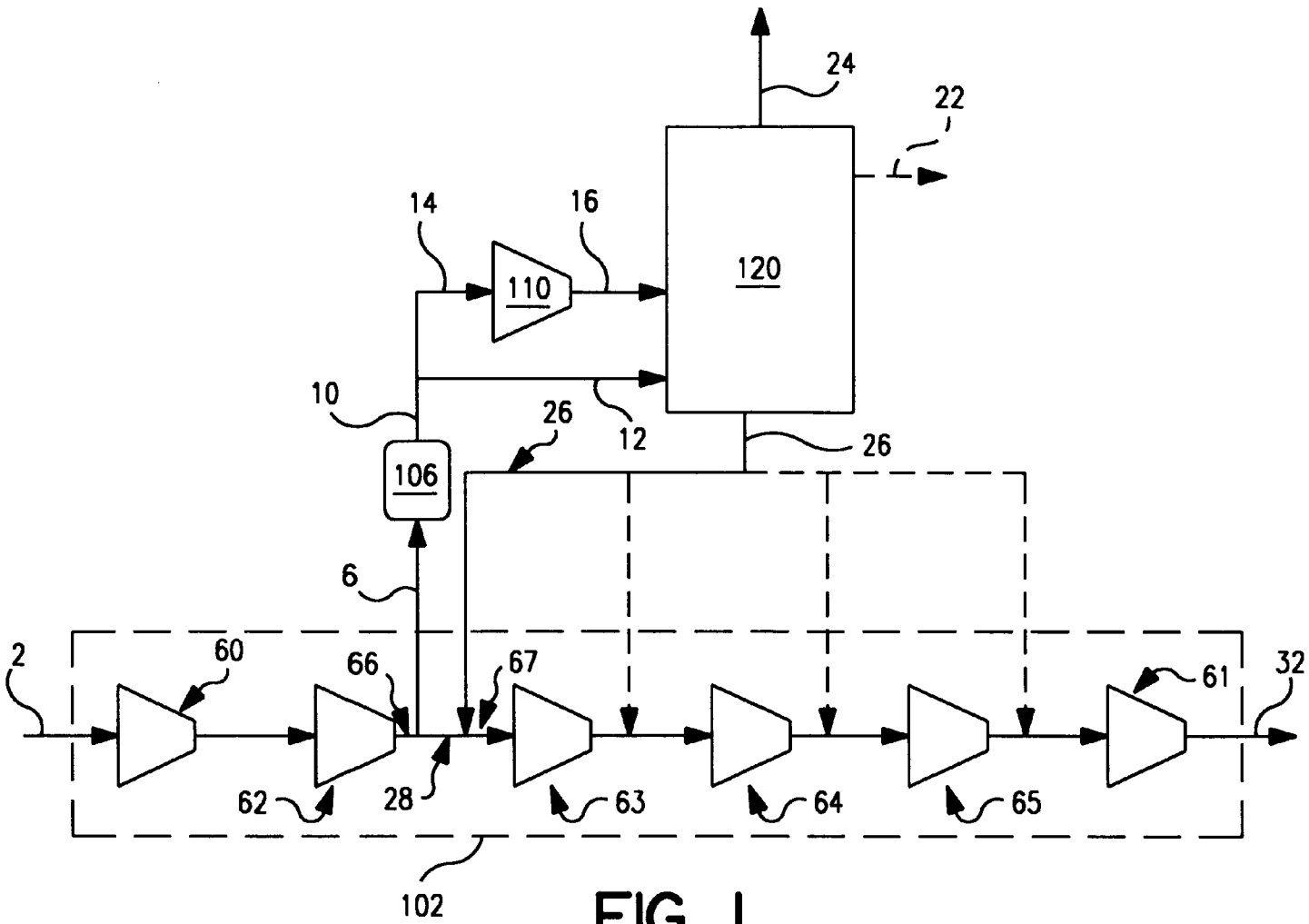
FIG. 1 is a simplified schematic representation of one embodiment of the cryogenic enriched air production system of this invention.

The invention will be described in detail with reference to the Drawings. Referring now to FIG. 1, feed air 2 is passed to multistage compressor 102 which comprises an initial stage 60, a final stage 61 and four intermediate stages designated 62, 63, 64 and 65. For the sake of simplicity the intercoolers between the stages are not shown. The feed air is compressed in initial stage 60 and in intermediate stage 62 to produce compressed feed air 66. A first portion 6 of the compressed feed air is passed to prepurifier 106 wherein it is cleaned of high boiling impurities such as carbon dioxide, water vapor and hydrocarbons. Resulting prepurified feed air 10 is divided into first feed stream 12 which is passed into the cryogenic air separation plant, shown in FIG. 1 in representational form as item 120, and into second feed stream 14 which is increased in pressure by passage through booster compressor 110 and then passed as stream 16 into cryogenic air separation plant 120.

Within cryogenic air separation plant 120 the feed air is separated by cryogenic rectification to produce oxygen fluid which is withdrawn from the cryogenic air separation plant in stream 26 at a pressure equal to or higher than the pressure of stream 6. In the embodiment illustrated in FIG. 1 there is also shown the production of nitrogen 24 and argon 22 by the cryogenic air separation plant. Oxygen fluid is passed from cryogenic air separation plant 120 in stream 26 to multistage compressor 102 wherein it mixes with the remaining or second portion 28 of the compressed feed air to form enriched air stream 67. Oxygen fluid may be withdrawn from the air separation plant as vapor, or it may be withdrawn as liquid, pumped to a higher pressure, vaporized and warmed prior to passage to the multistage compressor. In the embodiment illustrated in FIG. 1, oxygen fluid 26 is shown being passed into multistage compressor 102 at the same stage of compression, i.e. between the same two stages, stages 62 and 63, from where the feed air 6 was taken for passage into plant 120. However, this is not necessary and as shown by the dotted lines, stream 26 could pass into multistage compressor 102 at another downstream stage of compression so long as it is upstream of final stage 61. Enriched air 67 is further compressed by passage through the remaining stages of multistage compressor 102, which in the embodiment illustrated in FIG. 1 are stages 63, 64, 65 and 61, and is recovered from multistage compressor 102 as further compressed enriched air 32, at a pressure generally within the range of from 150 to 650 pounds per square inch absolute (psia).

Figure 2:
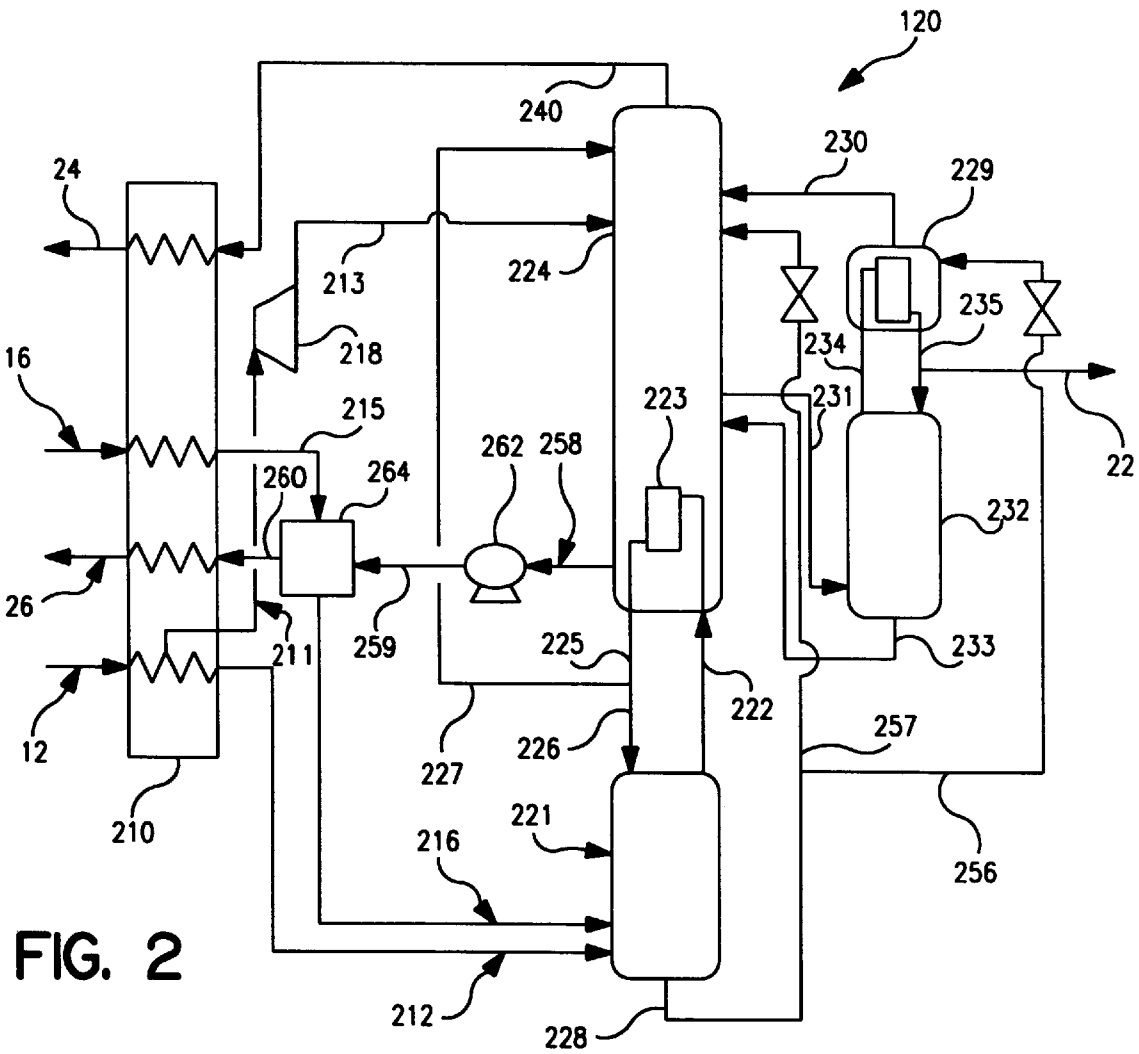
FIG. 2 is a representation of one embodiment of a cryogenic air separation plant which may be used in the practice of this invention.

FIG. 2 illustrates one embodiment of the cryogenic air separation plant which may be used as plant 120 in the practice of this invention Any other suitable cryogenic air separation can also be used as plant 120. Referring now to FIG. 2, feed air streams 16 and 12 are cooled in heat exchanger 210 by indirect heat exchange with return streams and are withdrawn from heat exchanger 210 as cooled feed air streams 212 and 215, respectively. A portion 211 of stream 12 is withdrawn from an intermediate point of heat exchanger 210, expanded by passage through expander 218, and passed as stream 213 into lower pressure column 224. Cooled, compressed feed air stream 215 is passed into vaporizer 264 wherein it is liquefied, as will be more fully described below, and from which it emerges as stream 216. Streams 216 and 212 are passed into higher pressure column 221 of cryogenic air separation plant 120 which also includes lower pressure column 224 and argon sidearm column 232. Within higher pressure column 221 the feed air is separated by cryogenic rectification into nitrogen-enriched vapor and oxygen-enriched liquid. Nitrogen-enriched vapor is passed in stream 222 into main condenser 223 wherein it is condensed by indirect heat exchange with lower pressure column 224 bottom liquid to form nitrogen-enriched liquid 225. A portion 226 of nitrogen-enriched liquid 225 is returned to higher pressure column 221 as reflux, and another portion 227 of nitrogen-enriched liquid 225 is subcooled (not shown) and then passed into lower pressure column 224 as reflux. Oxygen-enriched liquid is withdrawn from the lower portion of higher pressure column 221 in stream 228 and a portion 256 is passed into argon column top condenser 229 wherein it is vaporized by indirect heat exchange with argon-richer vapor, and the resulting oxygen-enriched fluid is passed as illustrated by stream 230 from top condenser 229 into lower pressure column 224. Another portion 257 of the oxygen-enriched liquid is passed directly into lower pressure column 224.

A stream 231 comprising oxygen and argon is passed from lower pressure column 224 into argon column 232 wherein it is separated by cryogenic rectification into argon-richer vapor and oxygen-richer liquid. The oxygen-richer liquid is returned to lower pressure column 224 in stream 233. The argon-richer vapor is passed in stream 234 into top condenser 229 wherein it condenses by indirect heat exchange with the vaporizing oxygen-enriched liquid as was previously described. Resulting argon-richer liquid is returned in stream 235 to argon column 232 as reflux. Argon-richer fluid, as vapor and/or liquid, is recovered from the upper portion of argon column 232 as product argon in stream 22.

Lower pressure column 224 is operating at a pressure less than that of higher pressure column 221. Within lower pressure column 224 the various feeds into the column are separated by cryogenic rectification into nitrogen-rich fluid and oxygen-rich fluid. Nitrogen-rich fluid is withdrawn from the upper portion of lower pressure column 224 as vapor stream 240, warmed by indirect heat exchange with stream 227 (not shown) and by passage through heat exchanger 210 and recovered as product nitrogen in stream 24. Oxygen-rich fluid is withdrawn from the lower portion of lower pressure column 224 as oxygen fluid stream 258. Stream 258 is pumped to a higher pressure by passage through pump 262 and resulting pressurized oxygen fluid stream 259 is vaporized in vaporizer 264 by indirect heat exchange with the aforesaid condensing feed air. The resulting vaporized oxygen fluid is withdrawn from vaporizer 264 in stream 260, warmed by passage through heat exchanger 210 and from there passed as stream 26 into multistage compressor 102.

Figure 3:
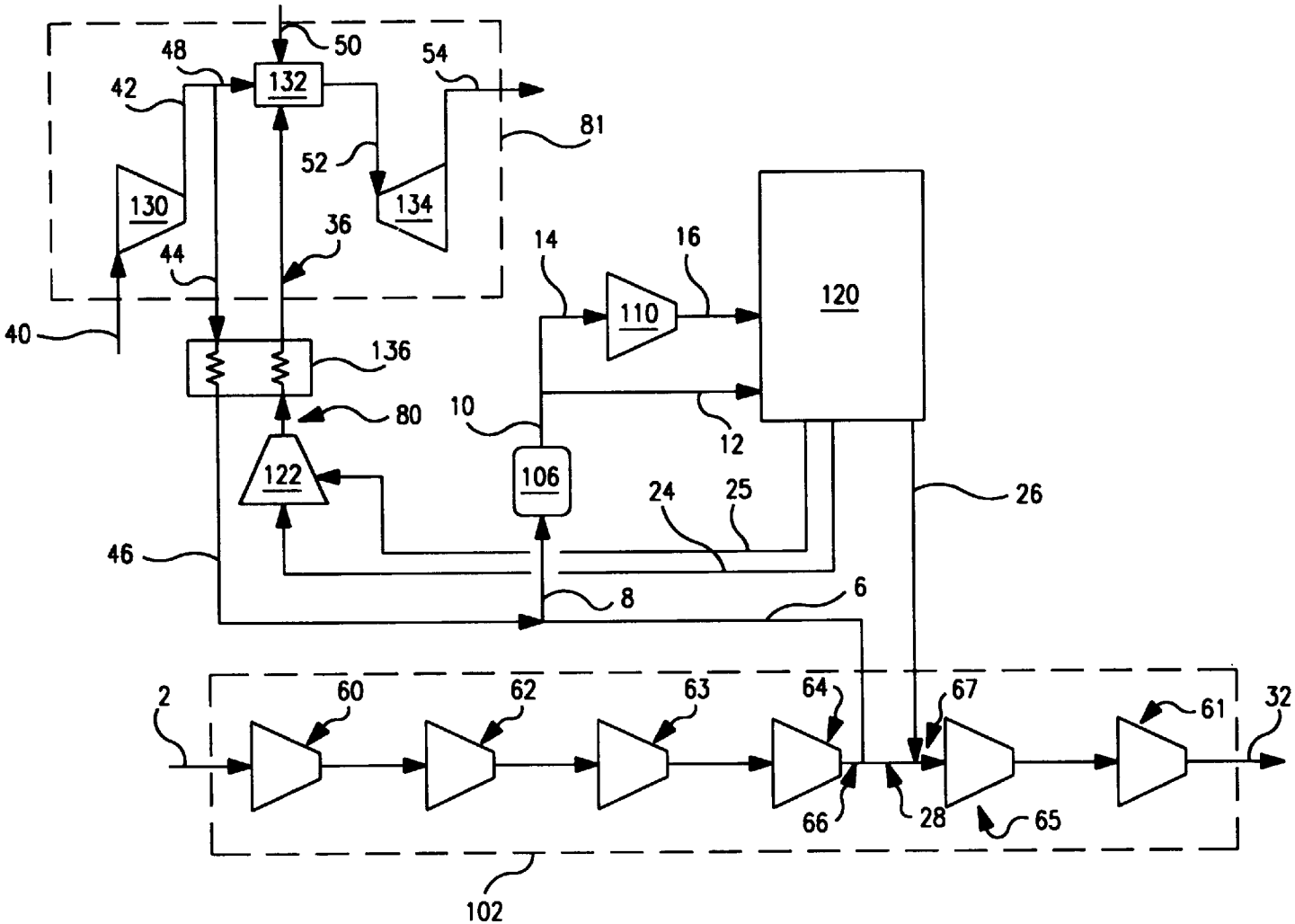
FIG. 3 is a representation of another embodiment of the invention wherein the cryogenic air separation plant is integrated with a gas turbine.

FIG. 3 illustrates another embodiment of the invention which further includes the integration of a gas turbine. As was the case with FIG. 2, the numerals of FIG. 3 are the same as those of FIGS. 1 for the common elements, and these common elements will not be described again in detail.

Referring now to FIG. 3, another feed air stream 40 is compressed in gas turbine compressor 130. A portion of resulting compressed air 42 is withdrawn via line 44. Compressed air in stream 44 is cooled first by indirect heat exchange with nitrogen from the cryogenic air separation plant and then by cooling water (not shown). A portion of compressed air 6 is withdrawn at substantially the same pressure as that of cooled air 46 and streams 6 and 46 are combined to produce stream 8 which is then prepurified in prepurifier 106. Nitrogen streams 24 and 25 (stream 25 is at higher pressure than stream 24) are compressed using compressor 122 and then the resulting compressed nitrogen 80 is heated by heat exchange with air in heat exchanger 136. The compressed and heated nitrogen stream 36 along with the remainder of gas turbine air 48 and fuel 50 are injected into combustor 132 of gas turbine 81. Fuel is combusted in combustor 132 and hot gas 52 from combustor 132 is expanded in turbine or expander 134. The turbine exhaust in stream 54 is sent to a heat recovery boiler.

Table 1 presents the results obtained in a simulation of the invention in accord with the embodiment illustrated in FIG. 1 and wherein the cryogenic air separation plant produces low purity oxygen. The stream numbers of Table 1 correspond to those of FIG. 1. The oxygen concentration is presented in volume percent.

TABLE 1

| Stream No. | Flow $ft^3/hr$ | Temperature ° F. | Pressure psia | $O_2$ Concentration |
|---|---|---|---|---|
| 2 | 4689456 | 70 | 14.7 | 20.74 |
| 6 | 1795303 | 80 | 62 | 20.74 |
| 12 | 1276138 | 80 | 59 | 20.95 |
| 16 | 501213 | 80 | 164 | 20.95 |
| 26 | 386064 | 75 | 63 | 95 |
| 28 | 2894153 | 80 | 62 | 20.74 |
| 32 | 3280217 | 200 | 650 | 29.5 |

Although the invention has been described in detail with reference to certain preferred embodiments, those skilled in the art will recognize that there are other embodiments of the invention within the spirit and the scope of the claims. For example the multistage compressor could have no intermediate stages or any practical number of intermediate stages depending upon the desired recovery pressure of the enriched air. Furthermore a portion of the oxygen-enriched air, either from after or from before the final stage of compression of the multistage compressor, could be prepurified and passed into the cryogenic air separation plant instead of stream 16. This latter embodiment is particularly useful when oxygen fluid is taken from the cryogenic air separation plant as liquid and the aforesaid enriched air recycle stream is used to vaporize the liquid oxygen fluid. This embodiment will also eliminate the need for booster compressor 110.

What is claimed is:

1. A method for producing enriched air comprising:

(A) passing feed air to a multistage compressor, compressing the feed air in the multistage compressor to produce compressed feed air, and passing a first portion of the compressed feed air into a cryogenic air separation plant;

(B) separating compressed feed air in the cryogenic air separation plant by cryogenic rectification to produce oxygen fluid;

(C) passing oxygen fluid from the cryogenic air separation plant to the multistage compressor, and mixing oxygen fluid within the multistage compressor with a second portion of the compressed feed air to produce enriched air; and (D) further compressing the enriched air within the multistage compressor and recovering further compressed enriched air from the multistage compressor.

2. The method of claim 1 wherein the oxygen fluid is passed from the cryogenic air separation plant to the multistage compressor at the same stage of compression as the first portion of the feed air was taken for passage into the cryogenic air separation plant.

3. The method of claim 1 wherein the feed air is compressed through at least two stages of the multistage compressor to produce the compressed feed air.

4. The method of claim 1 wherein the enriched air is further compressed through at least two stages of the multistage compressor.

5. The method of claim 1 further comprising compressing another feed air stream and passing a portion of said stream into the cryogenic air separation plant, and combusting another portion of said stream with fuel to produce hot gas and thereafter expanding the hot gas in a turbine.

6. Apparatus for producing enriched air comprising:

(A) a multistage compressor comprising an initial stage and a final stage, and means for passing feed air to the initial stage of the multistage compressor;

(B) a cryogenic air separation plant and means for passing feed air from the multistage compressor to the cryogenic air separation plant, said means communicating with the multistage compressor downstream of the initial stage;

(C) means for passing oxygen fluid from the cryogenic air separation plant to the multistage compressor at a point upstream of the final stage; and (D) means for recovering enriched air from the final stage of the multistage compressor.

7. The apparatus of claim 6 wherein the means for passing oxygen fluid to the multistage compressor communicates with the multistage compressor at the same stage of compression as where the means for passing feed air to the cryogenic air separation plant communicates with the multistage compressor.

8. The apparatus of claim 6 wherein the multistage compressor comprises a plurality of intermediate stages between the initial stage and the final stage.

9. The apparatus of claim 6 further comprising a gas turbine having a gas turbine compressor, a combustor and a turbine, means for passing feed air to the gas turbine compressor, means for passing feed air from the gas turbine compressor to the cryogenic air separation plant, means for passing feed air from the gas turbine compressor to the combustor, and means for passing hot gas from the combustor to the turbine.

10. The apparatus of claim 9 further comprising means for passing nitrogen from the cryogenic air separation plant to the combustor.

* * * * *